US011808047B2

(12) United States Patent
Cline et al.

(10) Patent No.: US 11,808,047 B2
(45) Date of Patent: Nov. 7, 2023

(54) CORNER STRUCTURES

(71) Applicant: CertainTeed Gypsum, Inc., Malvern, PA (US)

(72) Inventors: Stephen Cline, Bend, OR (US); Mithun N. Kamath, Northborough, MA (US); Michael House, Bend, OR (US); Nicole Love, Somerville, MA (US); Michael J. Lemberger, Dudley, MA (US)

(73) Assignee: CertainTeed Gypsum, Inc., Malvern, PA (US)

( * ) Notice: Subject to any disclaimer, the term of this patent is extended or adjusted under 35 U.S.C. 154(b) by 0 days.

(21) Appl. No.: 17/132,659

(22) Filed: Dec. 23, 2020

(65) Prior Publication Data

US 2021/0198903 A1 Jul. 1, 2021

Related U.S. Application Data

(60) Provisional application No. 62/954,105, filed on Dec. 27, 2019.

(51) Int. Cl.
*E04F 21/00* (2006.01)
*E04F 21/02* (2006.01)

(52) U.S. Cl.
CPC ..... *E04F 21/0053* (2013.01); *E04F 21/026* (2013.01)

(58) Field of Classification Search
CPC .... E04F 13/042; E04F 21/0053; E04F 21/026
See application file for complete search history.

(56) References Cited

U.S. PATENT DOCUMENTS 1,608,475 A * 11/1926 Dean ..... E04F 13/06 52/255
2,904,856 A * 9/1959 Robinson ..... E04F 13/06 52/255

(Continued)

OTHER PUBLICATIONS

International Search Report and Written Opinion in PCT/US2020/066854, dated Apr. 9, 2021.

*Primary Examiner* — James M Ference
(74) *Attorney, Agent, or Firm* — McDonnell Boehnen Hulbert & Berghoff LLP

(57) ABSTRACT

The present disclosure relates generally to building surface joint supports, for example, suitable for covering a seam between two building surface panels. In certain aspects, the disclosure provides joint supports that include an elongate layered structure having inside and outside surfaces, the elongate layered structure including a support strip that includes first and second elongate flanges. In certain embodiments, the elongate layered structure also includes an inner facing sheet disposed on the inside surface of the support strip; and an outer facing sheet disposed on the outside surface of the support strip, wherein the each of the inner facing sheet and the outer facing sheet is formed from a fibrous polymer material. In other embodiments, each flange of the first and second elongate flanges includes apertures therethrough, each aperture having a width that extends laterally across at least 50% of the width of the respective flange; and the elongate layer structure also includes an outer facing sheet disposed on the outside surface of the support strip.

23 Claims, 10 Drawing Sheets

(56) References Cited

U.S. PATENT DOCUMENTS 3,255,561 A * 6/1966 Cable ..... E04F 13/06 52/717.06
3,323,264 A * 6/1967 Cross ..... E04F 13/06 52/287.1
5,045,374 A * 9/1991 Tucker ..... E04F 19/028 428/83
5,048,247 A * 9/1991 Weldy ..... E04F 13/06 52/287.1
5,138,810 A * 8/1992 Kartler ..... E04F 13/06 52/255
5,246,775 A * 9/1993 Loscuito ..... C09J 7/21 428/41.5
5,254,387 A * 10/1993 Gallucci ..... B32B 3/14 428/113
5,418,027 A * 5/1995 Conboy ..... C09J 7/02 428/134
5,442,886 A * 8/1995 Iacobelli ..... E04F 13/06 52/255
5,620,768 A 4/1997 Hoffmann
5,711,124 A * 1/1998 Stough ..... E04F 13/042 52/417
5,752,353 A * 5/1998 Koenig ..... E04F 13/06 52/255
5,778,617 A * 7/1998 Free ..... E04F 13/06 411/466
5,813,179 A * 9/1998 Koenig, Jr. ..... E04F 19/028 52/287.1
5,816,002 A * 10/1998 Bifano ..... E04F 13/06 52/364
5,836,122 A 11/1998 Rennich et al.
5,839,241 A * 11/1998 Cacossa ..... E04F 13/06 52/287.1
5,943,835 A * 8/1999 von Saint-George .. E04F 13/06 52/287.1
6,073,406 A * 6/2000 Kearney ..... E04F 13/06 52/287.1
6,145,259 A * 11/2000 Koenig, Jr. ..... E04F 13/06 52/287.1
6,226,957 B1 * 5/2001 Stough ..... B32B 29/02 52/745.2
6,295,776 B1 * 10/2001 Kunz ..... E04F 13/06 156/153
6,447,872 B1 * 9/2002 Larson ..... E04F 13/06 428/122
6,539,680 B2 * 4/2003 Kunz ..... E04F 13/06 52/255
6,571,520 B2 * 6/2003 Koenig, Jr. ..... E04F 13/06 52/255
6,691,476 B1 * 2/2004 Kunz ..... E04F 13/06 52/255
6,722,092 B2 * 4/2004 Kunz ..... E04F 13/06 52/255
6,758,017 B2 * 7/2004 Young ..... E04F 19/022 403/205
6,779,313 B2 * 8/2004 Smythe, Jr. ..... E04F 13/06 52/255
7,013,610 B2 * 3/2006 Kunz ..... E04F 13/042 52/255
7,214,434 B2 5/2007 Dalgleish et al.
7,673,428 B1 * 3/2010 Smythe ..... E04F 13/06 52/255
8,079,601 B2 * 12/2011 Scardigno ..... E04B 1/6809 277/651
8,511,029 B2 * 8/2013 Hansen ..... E04G 23/0203 52/746.1
8,756,886 B1 * 6/2014 Grant ..... E04F 13/22 52/255
8,795,808 B2 * 8/2014 Spanton ..... E04F 21/165 428/112
8,813,448 B1 * 8/2014 Rensi ..... E04F 13/06 52/255
8,875,468 B2 * 11/2014 Dhinjan ..... E04F 13/06 52/741.3
8,910,437 B2 * 12/2014 Robertson ..... E04F 13/06 52/255
8,966,845 B1 * 3/2015 Ciuperca ..... E04B 2/56 52/309.12
9,085,906 B2 * 7/2015 Ward ..... E04F 19/022
9,140,015 B2 * 9/2015 Negri ..... C04B 26/16
9,290,929 B2 * 3/2016 Hawk ..... E04F 13/0851
9,303,413 B2 * 4/2016 Koenig, Jr. ..... E04F 19/028
9,365,455 B2 * 6/2016 Hargrove ..... E04F 13/04
9,377,160 B1 * 6/2016 Smythe ..... E04F 13/06
9,388,582 B1 * 7/2016 Smythe ..... E04F 13/068
9,446,546 B1 * 9/2016 Wambaugh ..... B29C 48/022
10,047,524 B2 * 8/2018 Smythe ..... E04F 13/068
D841,833 S * 2/2019 Apanovich ..... D25/119
D842,496 S * 3/2019 Apanovich ..... D25/119
D842,497 S * 3/2019 Apanovich ..... D25/119
10,458,122 B2 10/2019 Bodner et al.
2002/0073638 A1 * 6/2002 Kunz ..... E04F 13/06 52/255
2003/0033766 A1 * 2/2003 Smythe, Jr. ..... B32B 29/00 52/255
2003/0033770 A1 * 2/2003 Harel ..... E04F 13/06 52/287.1
2003/0131546 A1 * 7/2003 Kunz ..... E04F 13/068 52/255
2005/0252120 A1 * 11/2005 Haga ..... E04C 2/043 52/254
2006/0053712 A1 * 3/2006 Norton ..... A61B 5/7425 52/287.1
2006/0070324 A1 * 4/2006 Daly ..... E04F 13/042 52/287.1
2006/0070331 A1 * 4/2006 Yakobics ..... E04C 2/043 52/581
2006/0283115 A1 * 12/2006 Robertson ..... B32B 27/12 52/364
2008/0139064 A1 * 6/2008 Neill ..... E04F 19/062 156/60
2010/0326002 A1 * 12/2010 Sawada ..... E04F 13/0898 52/578
2011/0023392 A1 * 2/2011 Rosenthal ..... E04F 13/068 52/255
2012/0174509 A1 * 7/2012 Dhinjan ..... E04F 13/06 52/255
2013/0145706 A1 * 6/2013 Norton ..... A61B 5/6802 52/287.1
2014/0260019 A1 * 9/2014 Conboy ..... C09J 7/22 52/255
2015/0204077 A1 * 7/2015 Mikulecky ..... D03D 3/005 442/187
2017/0081562 A1 * 3/2017 Rosenthal ..... C09J 7/32
2017/0138058 A1 * 5/2017 Swartz ..... E04F 13/042
2017/0314274 A1 * 11/2017 Rosenthal ..... E04F 13/24
2017/0335569 A1 * 11/2017 Kruger ..... E04F 13/042
2018/0171646 A1 * 6/2018 Stahl ..... E04F 21/0053
2019/0017280 A1 * 1/2019 Mineo ..... E04F 21/0053
2021/0140179 A1 * 5/2021 House ..... E04F 21/1657
2021/0198903 A1 * 7/2021 Cline ..... E04F 21/0053

* cited by examiner

CORNER STRUCTURES

CROSS-REFERENCE TO RELATED APPLICATIONS

This application claims the benefit of priority of U.S. Provisional Patent Application No. 62/954,105, filed Dec. 27, 2019, which is hereby incorporated herein by reference in its entirety.

BACKGROUND OF THE DISCLOSURE

1. Field of the Disclosure

The present disclosure relates generally to building surface joint supports, for example, suitable for covering a seam between two building surface panels.

2. Technical Background

Building surface panels, such as drywall panels, are commonly used to create walls, ceilings, and other building surfaces in homes, businesses and other buildings. The panels are typically attached to a frame that holds the panels in place. Often, the edges between the panels are covered in order to create a smooth surface from one panel to the next. For example, in many instances, the joints or seams between adjacent panels are covered with a joint compound that is shaped to form a flat surface or clean corner at the joint. To strengthen the joint, the neighboring panels can be secured with a joint support, such as joint tape or a corner bead. The joint support aids in both securing the surface between the two panels, and in providing the desired shape at the seam.

Sometimes, a joint support is manufactured with facing sheets. Such facing sheets provide a smooth transition from the joint support to the building surface panel so as to minimize the visibility of the edge of the joint support. Moreover, the facing sheets can enhance adhesion of a joint compound to the joint support. However, facing sheets found in conventional joint supports, for instance paper facing sheets, have a potential for mold growth, are unable to resist sanding during a finishing process, are not impact resistant, and exhibit too much elasticity. These issues make conventional joint supports difficult to use.

Beyond this, many conventional joint supports contain extraneous materials that do not increase to the strength or rigidity of the final product. Since the materials used to manufacture joint supports can be expensive, adding extraneous materials to a joint support creates unnecessary costs for manufacturers.

Accordingly, the present inventors have determined that joint supports which incorporate unconventional materials and that could be manufactured in a way that reduces extraneous materials would be attractive to builders and manufacturers alike.

SUMMARY OF THE DISCLOSURE

The present disclosure relates generally to building surface joint supports, for example, suitable for covering a seam between two building surface panels.

In one aspect, the present disclosure provides a joint support comprising:

an elongate layered structure including a length that extends from a first end to a second end, an inside surface, and an outside surface, the elongate layered structure comprising:

a support strip that extends from the first end to the second end, the support strip including an inside surface, an outside surface, and first and second elongate flanges, each of the first and second elongate flanges having a width that extends from an inner edge to an outer edge;

an inner facing sheet disposed on the inside surface of the support strip; and an outer facing sheet disposed on the outside surface of the support strip, wherein the each of the inner facing sheet and the outer facing sheet is formed from a fibrous polymer material.

In another aspect, the present disclosure provides a joint support comprising:

an elongate layered structure including a length that extends from a first end to a second end, an inside surface, and an outside surface, the elongate layered structure comprising a support strip that extends from the first end to the second end, the support strip including an inside surface, an outside surface, and first and second elongate flanges, each of the first and second elongate flanges having a width that extends from an inner edge to an outer edge, wherein each flange of the first and second elongate flanges includes apertures therethrough, each aperture having a width that extends laterally across at least 50% of the width of the respective flange; an an outer facing sheet disposed on the outside surface of the support strip.

In another aspect, the disclosure provides a building surface construction using the joint support of the disclosure, the building surface construction comprising:

a first building surface panel;

a second building surface panel adjacent to the first building surface panel so as to form a seam between the first building surface panel and second building surface panel; and the joint support disposed over the first building surface panel and the second building surface panel and covering a portion of the seam.

In another aspect, the disclosure provides a method of manufacturing the joint support of the disclosure, the method comprising:

extruding the support strip;

providing the outer facing sheet, and securing the outer facing sheet to the outside surface of the support strip so as to form the elongate layered structure.

Additional aspects of the disclosure will be evident from the disclosure herein.

BRIEF DESCRIPTION OF THE DRAWINGS

The accompanying drawings are included to provide a further understanding of the methods and devices of the disclosure, and are incorporated in and constitute a part of this specification. The drawings are not necessarily to scale, and sizes of various elements may be distorted for clarity. The drawings illustrate one or more embodiment(s) of the disclosure, and together with the description serve to explain the principles and operation of the disclosure.

DETAILED DESCRIPTION

The present inventors have noted that joint supports formed of conventional materials, for example a joint support that includes paper facing sheets, often have a potential for mold growth, are unable to resist sanding during a finishing process, are not impact resistant, and exhibit too much elasticity. The present inventors have determined that a joint support formed of non-conventional materials, for example a joint support that includes facing sheets made from fibrous polymer materials such as nylon, could solve these and other issues. Such joint supports would be attractive to manufacturers and builders alike.

Further, the present inventors have noted that conventional joint supports often contain extraneous materials that do not add to the strength or rigidity of the final product. The present inventors have determined that a joint support formed with large mesh-like apertures could reduce the amount of materials used in manufacturing the joint support while still retaining the joint support's original strength and rigidity. The reduction in material costs would be attractive to manufacturers of such joint supports.

Accordingly, one aspect of the disclosure is a joint support comprising an elongate layered structure. The elongate layered structure has a length that extends from a first end to a second end, an inside surface, and an outside surface. The elongate layered structure includes a support strip that extends from the first end to the second end. The support strip includes an inside surface, an outside surface, and first and second elongate flanges, each of the first and second elongate flanges having a width that extends from an inner edge to an outer edge. The elongate layered structured also includes an inner facing sheet disposed on the inside surface of the support strip. The elongate layered structured further includes an outer facing sheet disposed on the outside surface of the support strip. At least one of the inner facing sheet and the outer facing sheet is formed from a fibrous polymer material.

Figure 1:
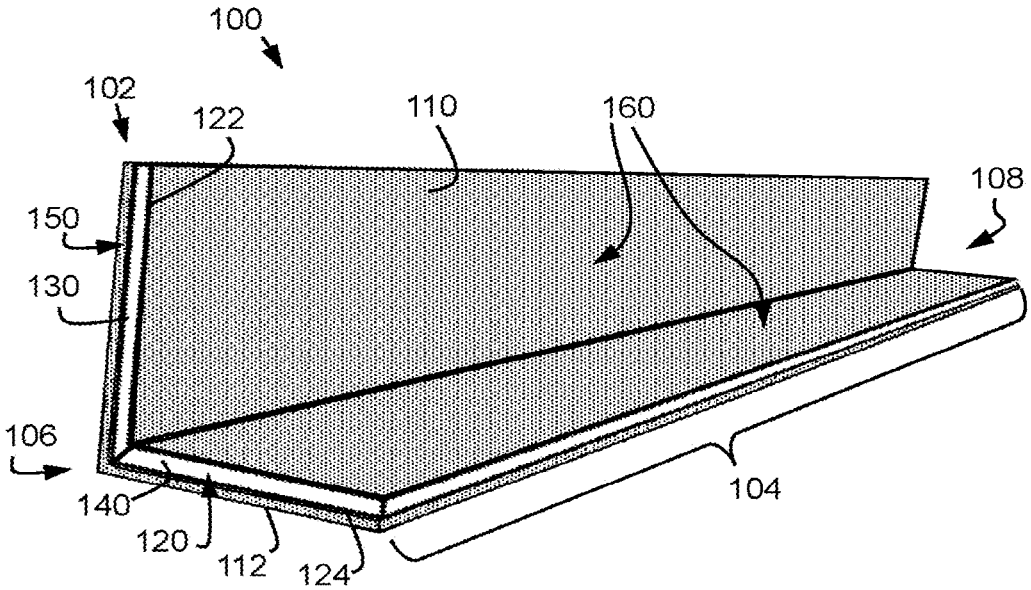
FIG. 1 is a schematic perspective view of a joint support according to an embodiment of the disclosure.
Figure 2:
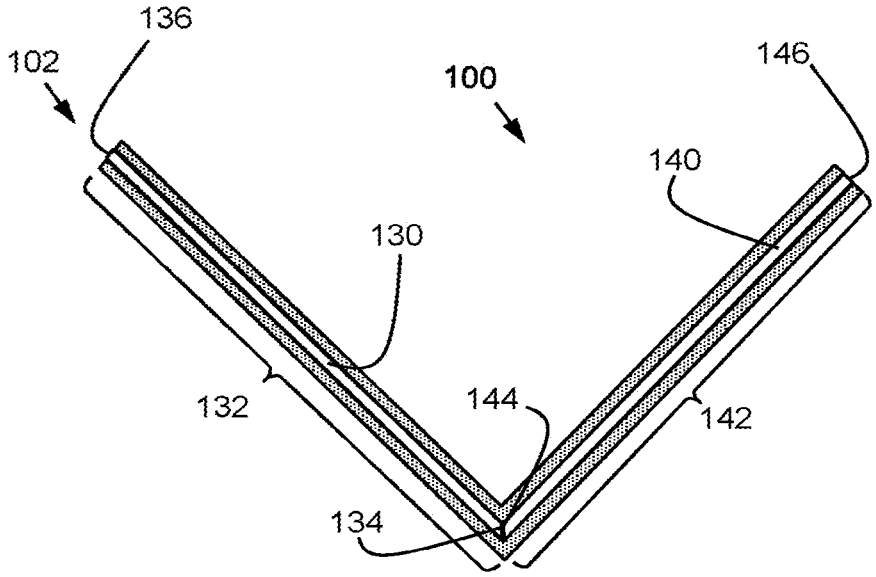
FIG. 2 is a schematic end view of the joint support of FIG. 1.

Such a joint support is illustrated in FIGS. 1 and 2. As shown in a perspective view of joint support 100 provided in FIG. 1, joint support 100 includes elongate layered structure 102 that has length 104, first end 106, and second end 108. Length 104 is the largest dimension of elongate layered structure 102 and is substantially greater than the width or breadth of elongate layered structure 102. Further, first end 106 and second end 108 are defined with respect to length 104. Elongate layered structure 102 also includes inside surface 110 and outside surface 112. When installed, inside surface 110 of elongate layered structure 102 is configured to face toward a building surface whereas outside surface 112 is configured to face away from the building surface (e.g., face the interior of a room). As explained in more detail below, in some embodiments, the outside surface of the elongate layered structure is designed to receive a covering layer of joint compound.

Elongate layered structure 102 includes support strip 120 as one of its layers. Support strip 120 extends from first end 106 to second end 108 and includes inside surface 122, outside surface 124, first elongate flange 130, and second elongate flange 140.

Elongate layered structure 102 also includes outer facing sheet 150 as one of its layers. The inside surface of outer facing sheet 150 is disposed on outside surface 124 of support strip 120. Thus, the outside surface of outer facing sheet 150 is also the outside surface of elongate layered structure 102 (e.g., the outside surface of outer facing sheet 150 is the same surface as outside surface 112). In other embodiments, a further layer covers the outer facing sheet and forms the outside surface of the elongate layered structure.

Further, elongate layered structure 102 includes inner facing sheet 160 as one of its layers. The outside surface of inner facing sheet 160 is disposed on inside surface 122 of support strip 120. Thus, the inside surface of inner facing sheet 160 is the inside surface of elongate layered structure 102 (e.g., the inside surface of inner facing sheet 160 is the same surface as inside surface 110). Again, in other embodiments, a further layer covers the inner facing sheet and forms the inside surface of the elongate layered structure. Additionally, in some embodiments, the elongate layered structure does not include an inner facing sheet.

As shown in the schematic end view of joint support 100 provided in FIG. 2, first elongate flange 130 of support strip 120 has width 132 that extends from inner edge 134 of first elongate flange 130 to outer edge 136 of first elongate flange 130. Likewise, second elongate flange 140 of support strip 120 has width 142 that extends from inner edge 144 of second elongate flange 140 to outer edge 146 of second elongate flange 140. Inner edge 134 and inner edge 144 are proximate to a center of joint support 100 whereas outer edge 136 and outer edge 146 are at laterally distal areas of joint support 100.

At least one of outer facing sheet 150 and inner facing sheet 160 is formed from a fibrous polymer material. For example, in some embodiments, the outer facing sheet is formed from a fibrous polymer material and the inner facing sheet is not formed from a fibrous polymer material. In other embodiments, the outer facing sheet is not formed from a fibrous polymer material and the inner facing sheet is formed from a fibrous polymer material. In yet other embodiments, each of the outer facing sheet and the inner facing sheet is formed from a fibrous polymer material.

When compared to conventional joint supports that include paper facing sheets, the fibrous polymer material enables joint support 100 to be more durable during sanding, stronger, more impact resistant, and more rigid. Further, the fibrous polymer material reduces the potential for mold growth on joint support 100 because the fibrous polymer material includes less natural materials than found in conventional paper facing sheets. Moreover, the fibrous polymer material also enhances adhesion of a joint compound to joint support 100. Other advantages of using the fibrous polymer material are also possible.

In certain embodiments of the joint support as otherwise described herein, at least one of the outer facing sheet and the inner facing sheet is a nylon ribbon. For example, in some embodiments, the outer facing sheet is a nylon ribbon and the inner facing sheet is not a nylon ribbon. In other embodiments, the outer facing sheet is not a nylon ribbon and the inner facing sheet is a nylon ribbon. In yet other embodiments, each of the outer facing sheet and the inner facing sheet is a nylon ribbon. In some embodiments, at least one the outer facing sheet and the inner facing sheet is made from individual nylon fibers. In other embodiments, at least one of the outer facing sheet and the inner facing sheet is formed from another fibrous polymer material, including semi-synthetic fibers, such as polyethylene terephthalate (PET) polyester, cellulose regenerated fibers, such as rayon, or metallic fibers, among other possibilities.

In another aspect, the disclosure provides for a joint support comprising an elongate layered structure. The elongate layered structure has a length that extends from a first end to a second end, an inside surface, and an outside surface. The elongate layered structure includes a support strip that extends from the first end to the second end. The support strip includes an inside surface, an outside surface, and first and second elongate flanges, each of the first and second elongate flanges having a width that extends from an inner edge to an outer edge. Both the first elongate flange and the second elongate flange include apertures therethrough. Each aperture has a width that extends laterally across at least 50% of the width of the respective flange that the aperture is part of. The elongate layered structured further includes an outer facing sheet disposed on the outside surface of the support strip.

Figure 3:
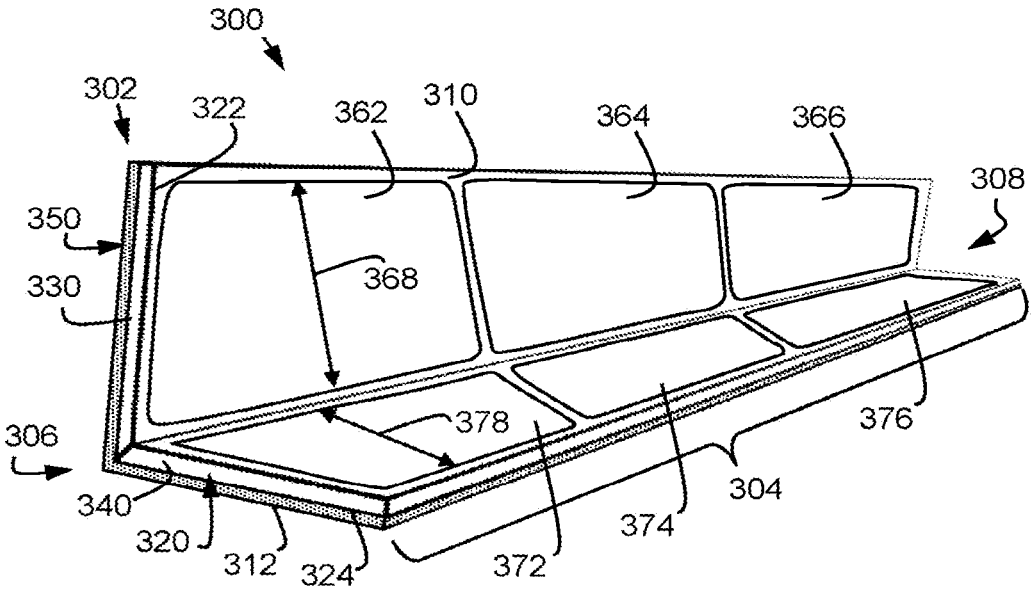
FIG. 3 is a schematic perspective view of a joint support according to another embodiment of the disclosure.
Figure 4:
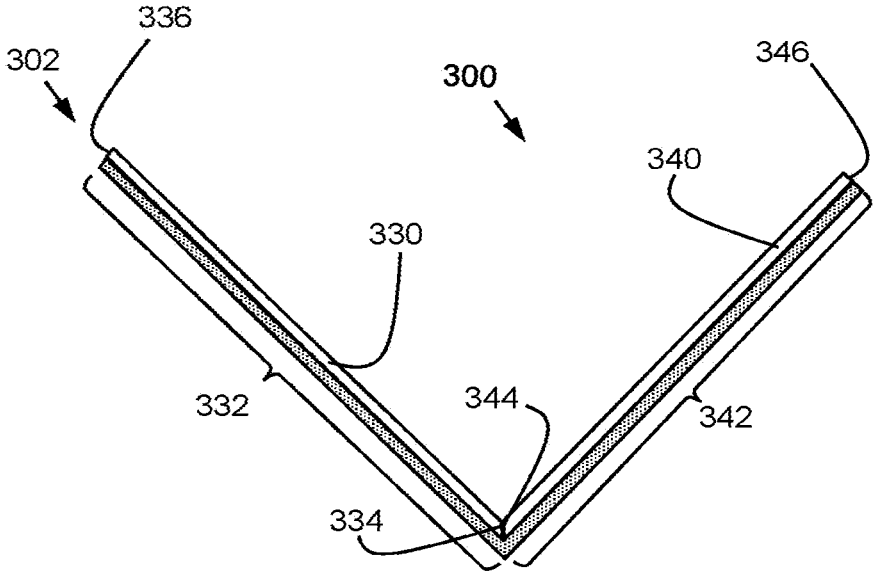
FIG. 4 is a schematic end view of the joint support of FIG. 3.

Such a joint support is illustrated in FIGS. 3 and 4. As shown in a perspective view of joint support 300 provided in FIG. 3, joint support 300 includes elongate layered structure 302 that has length 304, first end 306, and second end 308. Length 304 is the largest dimension of elongate layered structure 302 and is substantially greater than the width or breadth of elongate layered structure 302. Further, first end 306 and second end 308 are defined with respect to length 304. Elongate layered structure 302 also includes inside surface 310 and outside surface 312. When joint support 300 is installed, inside surface 310 is configured to face towards a building surface whereas outside surface 312 is configured to face away from a building surface (e.g., face the interior of a room). As explained in more detail below, in some embodiments, the outside surface of the elongate layered structure is designed to receive a covering layer of joint compound.

Elongate layered structure 302 includes support strip 320 as one of its layers. Support strip 320 extends from first end 306 to second end 308 and includes an inside surface 322, outside surface 324, first elongate flange 330, and second elongate flange 340. Notably, inside surface 322 of support strip 320 is the same surface as inside surface 310 of elongate layered structure 302. In other embodiments, a further layer covers the support strip and forms the inside surface of the elongate layered structure.

As shown, first elongate flange 330 includes apertures 362, 364, and 366. Apertures 362, 364, and 366 extend through first elongate flange 330 so as to form openings in first elongate flange 330. Likewise, second elongate flange 340 includes apertures 372, 374, and 376. Apertures 372, 374, and 376 extend through second elongate flange 340 so as to form openings in second elongate flange 340. Advantageously, the introduction of apertures 362, 364, 366, 372, 374, and 376 into joint support 300 reduces the amount of materials needed to manufacture first elongate flange 330 and second elongate flange 340 while still providing sufficient strength to joint support 300.

Elongate layered structure 302 additionally includes outer facing sheet 350 as one of its layers. The inside surface of outer facing sheet 350 is disposed on outside surface 324 of support strip 320. Thus, the outside surface of outer facing sheet 350 is the outside surface of elongate layered structure 302 (e.g., the outside surface of outer facing sheet 350 is the same surface as outside surface 312). In other embodiments, a further layer covers the outer facing sheet and forms the outside surface of the elongate layered structure.

As shown in the schematic end view of joint support 300 provided in FIG. 4, first elongate flange 330 of support strip 320 has width 332 that extends from inner edge 334 of first elongate flange 330 to outer edge 336 of first elongate flange 330. Likewise, second elongate flange 340 of support strip 320 has width 342 that extends from inner edge 344 of second elongate flange 340 to outer edge 346 of second elongate flange 340. Inner edge 334 and inner edge 344 are proximate to a center of joint support 300 whereas outer edge 336 and outer edge 346 are at laterally distal areas of joint support 300. Moreover, apertures 362, 364, and 366 of first elongate flange 330 each have a width extends laterally across at least 50% of width 332. For example, width 368 of aperture 362 extends laterally across at least 50% of width 332. Similarly, apertures 372, 374, and 376 of second elongate flange 340 each have a width extends laterally across at least 50% of width 342. For example, width 378 of aperture 372 extends laterally across at least 50% of width 342.

In other embodiments, each aperture has a width that extends laterally across at least 65% of the width of the respective flange that the aperture is part of. In yet other embodiments, each aperture has a width that extends laterally across at least 75% of the width of the respective flange that the aperture is part of. In certain embodiments of the joint support as otherwise described herein, the width of each aperture is at least 20 mm, e.g., at least 25 mm, e.g., at least 40 mm.

In certain embodiments of the joint support as otherwise described herein, the apertures are spaced uniformly along the length of the support strip. For example, as shown in FIG. 3, apertures 362, 364, and 366 of first elongate flange 330 are each spaced at a uniform distance from each other along length 304. Likewise, apertures 372, 374, and 376 of second elongate flange 340 are each spaced at a uniform distance from each other along length 304.

Figure 5:
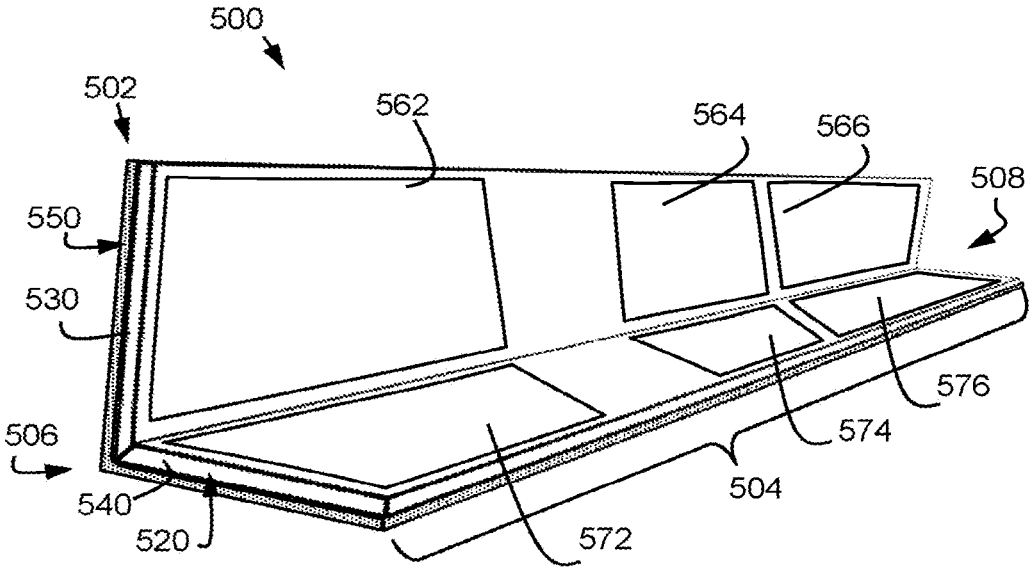
FIG. 5 is a schematic perspective view of a joint support according to yet another embodiment of the disclosure.

In other embodiments, the apertures are spaced non-uniformly along the length of the support strip. Such a joint support is shown in FIG. 5. Joint support 500 includes elongate layered structure 502. Elongate layered structure 502 has length 504 that extends from first end 506 to second end 508 and includes support strip 520 and outer facing sheet 550 as its layers. Support strip 520 includes first elongate flange 530 and second elongate flange 540. Apertures 562, 564, and 566 extend through first elongate flange 530 and apertures 572, 574, and 576 extend through second elongate flange 540. As shown, apertures 562, 564, and 566 are spaced non-uniformly from each other along length 504 (e.g., the distance between aperture 562 and 564 is greater than the distance between aperture 564 and 566). Likewise, apertures 572, 574, and 576 are spaced non-uniformly from each other along length 504 (e.g., the distance between aperture 572 and 574 is greater than the distance between aperture 574 and 576).

Figure 6:
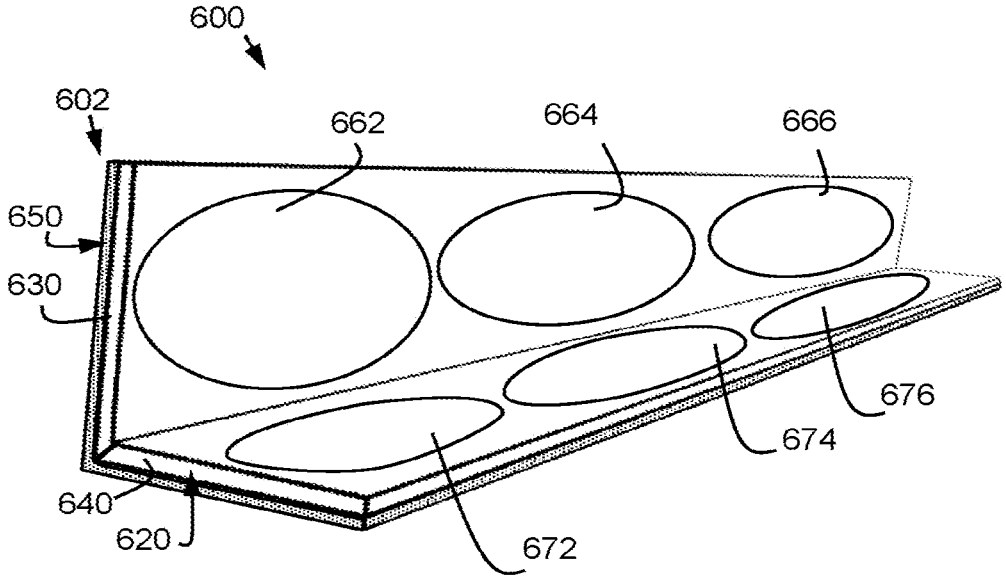
FIG. 6 is a schematic perspective view of a joint support according to another embodiment of the disclosure.

In certain embodiments of the joint support as otherwise described herein, the apertures include non-polygonal shaped aperture. For example, as shown in FIG. 3, apertures 362, 364, 366, 372, 374 and 376 are all non-polygonal shaped apertures. In some embodiments, the apertures include ellipse shaped apertures. Such a joint support is shown in FIG. 6. Joint support 600 includes elongate layered structure 602. Elongate layered structure 602 includes support strip 620 and outer facing sheet 650 as its layers. Support strip 620 includes first elongate flange 630 and second elongate flange 640. Support strip 620 is shown to include ellipse shaped apertures 662, 664, 666, 672, 674, and 676. Apertures 662, 664, 666, 672, 674, and 676 are shown to be relatively the same size. However, in other embodiments, the apertures through the support strip have different sizes. Other examples of non-polygonal shaped apertures include crescent shaped apertures, arch shaped apertures, and circle shaped apertures, among other possibilities.

Figure 7:
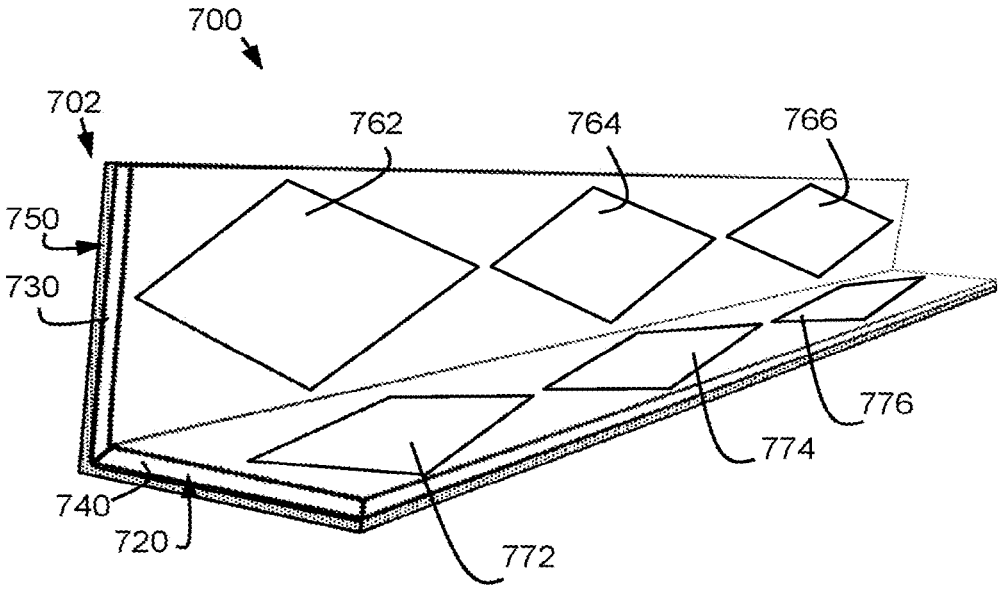
FIG. 7 is a schematic perspective view of a joint support according to still another embodiment of the disclosure.

In certain embodiments of the joint support as otherwise described herein, the apertures include polygonal shaped apertures. For example, as shown in FIG. 5, apertures 562, 564, 566, 572, 574 and 576 are all polygonal shaped apertures, specifically rectangular shaped apertures. In some embodiments of the joint support as otherwise described herein, the apertures include diamond shaped apertures. Such a joint support is shown in FIG. 7. Joint support 700 includes elongate layered structure 702. Elongate layered structure 702 includes support strip 720 and outer facing sheet 750 as its layers. Support strip 720 includes first elongate flange 730 and second elongate flange 740. Support strip 720 is shown to include diamond shaped apertures 762, 764, 766, 772, 774, and 776. Apertures 762, 764, 766, 772, 774, and 776 are shown to be relatively the same size. However, in other embodiments, the apertures through the support strip have different sizes. Other examples of polygonal shaped apertures include rhombus shaped apertures, triangle shaped apertures, square shaped apertures, and trapezoid shaped apertures, among other possibilities.

Figure 8:
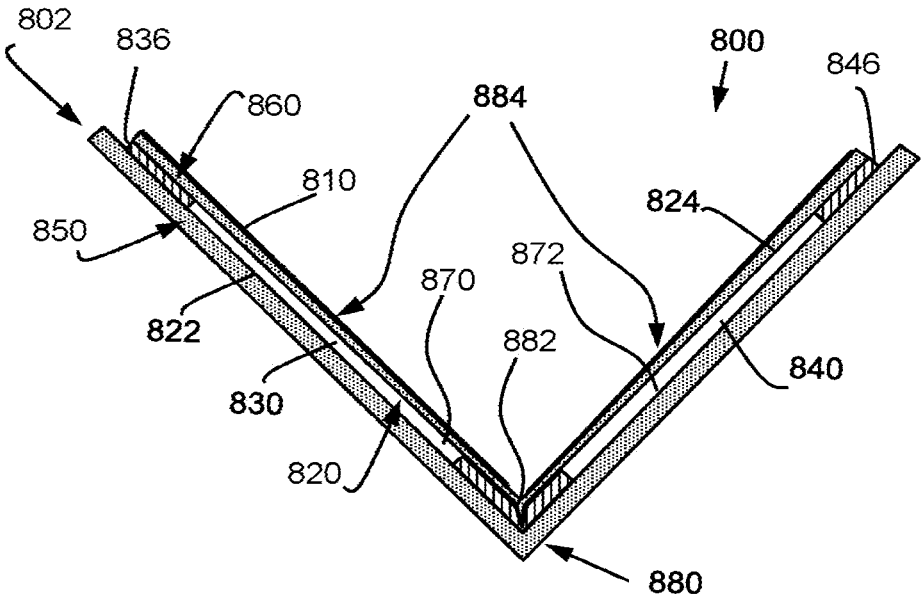
FIG. 8 is a schematic cross sectional view of a joint support according to another embodiment of the disclosure.
Figure 9:
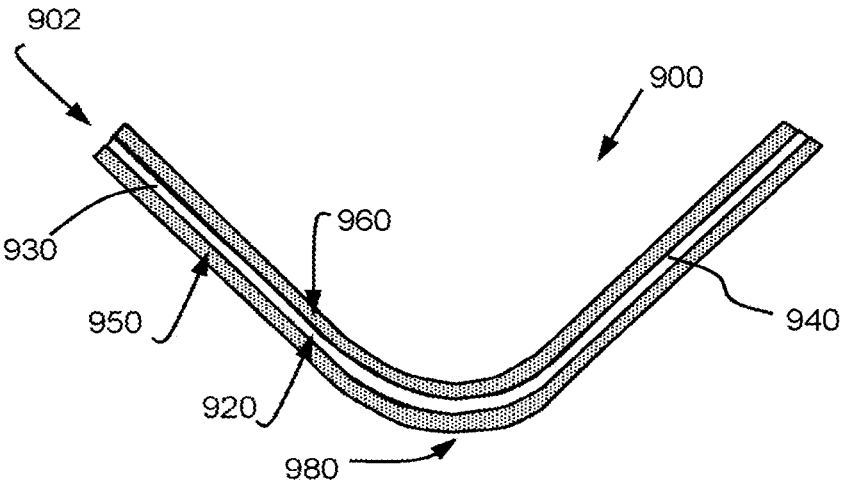
FIG. 9 is a schematic end view of a joint support according to yet another embodiment of the disclosure.

In certain embodiments of the joint support as otherwise described herein, the joint support comprises an inner facing sheet disposed on the inside surface of the support strip. A cross section view of such a joint support is shown in FIG. 8. Joint support 800 includes elongate layered structure 802. Elongate layered structure 802 includes support strip 820, outer facing sheet 850 and inner facing sheet 860 as part of its layers. Outer facing sheet 850 is attached to the outside surface of support strip 820 and inner facing sheet 860 is attached to the inside surface of support strip 820. Further, support strip 820 includes first elongate flange 830 and second elongate flange 840. First elongate flange 830 includes aperture 870 (represented in solid white) therethrough and second elongate flange 840 includes aperture 872 (also represented in solid white) therethrough.

In certain embodiments of the joint support as otherwise described herein, an adhesive substance is disposed on the inside surface of the elongate layered structure. For example, as shown in FIG. 8, adhesive substance 884 is disposed on inside surface 810 of elongate layered structure 802. The adhesive substance allows the joint support to be conveniently attached to building surface panels without a layer of joint compound between the joint support and the panels. Accordingly, subsequent steps in the construction of the building surface can be carried out as soon as the adhesive is adhered to the building surface, and without the need to wait for a layer of joint compound to dry. Furthermore, the adhesive substance also allows the joint support to be installed without requiring mechanical fasteners, which can lead to increased efficiency in the installation.

A variety of adhesive substances are suitable for use in the joint supports and methods of the disclosure. The adhesive substances are typically based on an elastomeric material, often with a tackifier to provide stickiness. In certain embodiments of the joint support as otherwise described herein, the adhesive substance is based on an acrylic polymer, e.g., based on one or more acrylate or methacrylate monomers such as acrylic acid, isobutyl acrylate, n-propyl acrylate, n-butyl acrylate, ethyl acrylate, isopropyl acrylate, 2-ethylhexyl acrylate, lauryl acrylate, lauryl methacrylate, isodecyl acrylate, isooctyl acrylate, tridecyl methacrylate, tridecyl acrylate, 2-ethylhexyl methacrylate, and caprolactone acrylate. Other suitable substances include epoxy resins, polyvinyl acetate, ethylene-vinyl acetate copolymer (e.g., with high vinyl acetate content); butyl rubbers, natural rubbers, nitriles, silicone rubbers, polyurethane, styrene-butadiene rubbers, styrene-isoprene rubbers, styrene block copolymers like styrene-butadiene-styrene (SBS), styrene-ethylene/butylene-styrene (SEBS), styrene-ethylene/propylene (SEP), and styrene-isoprene-styrene (SIS). A variety of tackifiers can be used, depending on the elastomer, e.g., resins (e.g. rosins and their derivates, terpenes and modified terpenes, aliphatic, cycloaliphatic and aromatic resins, hydrogenated hydrocarbon resins, and their mixtures, terpene-phenol resins (especially with ethylene-vinyl acetate adhesives)), novolacs, silicone tackifiers based on so-called "MQ" silicate resins (based on monofunctional trimethylsilane reacted with silicon tetrachloride, especially for silicone rubbers). Many other adhesives and adhesive precursors are known in the art with different modes of operation and may be used as the adhesive substance. The adhesive substance can be selected to provide compatibility with the other materials and provide a necessary amount of strength to bond with a building surface.

In certain embodiments of the joint support as otherwise described herein, the support strip includes a sharp corner connecting the first elongate flange and the second elongate flange. For example, as shown in FIG. 8, support strip 820 of joint support 800 includes sharp corner 880 connecting first elongate flange 830 and second elongate flange 840. Sharp corner 880 provides a clean sharp corner edge where joint support 800 covers the seam between the building surface panels. In certain embodiments, a groove is disposed on an inside surface of the sharp corner. For example, groove 882 is shown to be disposed on the inside surface of sharp corner 880. Groove 882 allows first elongate flange 830 and second elongate flange 840 to flex with respect to one another as joint support 800 is placed over the corner formed by the adjacent building surface panels. This allows joint support 800 to be operable with a range of angles between two building surface panels.

On the other hand, in certain embodiments of the joint support as otherwise described herein, the support strip includes a rounded corner connecting the first elongate flange and the second elongate flange so as to form a bull-nose corner bead. Such a joint support is shown in FIG.

9. Joint support 900 includes elongate layered structure 902. Elongate layered structure 902 includes support strip 920, outer facing sheet 950 and inner facing sheet 960 as part of its layers. Outer facing sheet 950 is attached to the outside surface of support strip 920 and inner facing sheet 960 is attached to the inside surface of support strip 920. Further, support strip 920 includes first elongate flange 930 and second elongate flange 940. First and second elongate flanges 930 and 940 are connected to one another by rounded corner 980, such that joint support 900 is constructed as a corner bead with a bull nose configuration. Rounded corner 980 of joint support 900 allows a uniform round edge to be provided at the seam between two building surface panels that are disposed at an angle to one another.

Figure 10:
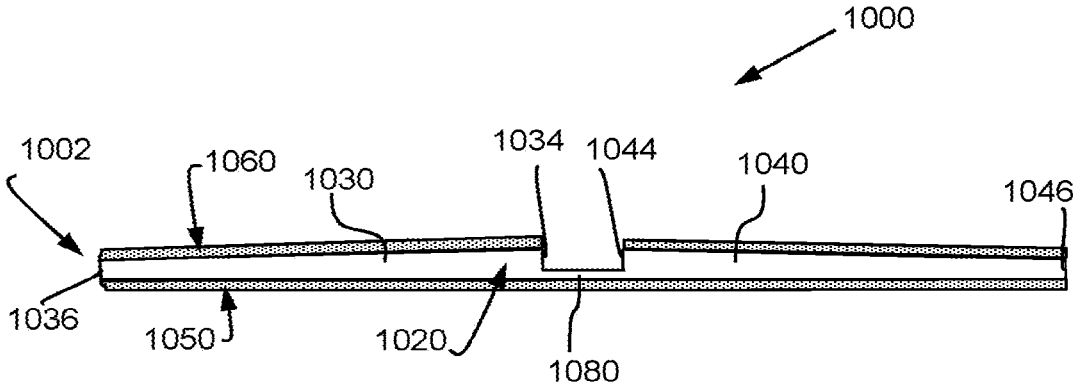
FIG. 10 is a schematic end view of a joint support according to still another embodiment of the disclosure.

In certain embodiments of the joint support as otherwise described herein, the first elongate flange is connected to the second elongate flange by a flexible hinge. Such a joint support is shown in FIG. 10. Joint support 1000 includes elongate layered structure 1002. Elongate layered structure 1002 includes support strip 1020, outer facing sheet 1050 and inner facing sheet 1060 as part of its layers. Outer facing sheet 1050 is attached to the outside surface of support strip 1020 and inner facing sheet 1060 is attached to the inside surface of support strip 1020. Further, support strip 1020 includes first elongate flange 1030 and second elongate flange 1040. First and second elongate flanges 1030 and 1040 are connected to one another by flexible hinge 1080. Flexible hinge 1080 allows joint support 1000 to fit over a seam between building surface panels disposed at any angle to one another, including parallel or coplanar panels.

In certain embodiments of the joint support as otherwise described herein, the first elongate flange and second elongate flange are disposed at an angle in a range from 45° to 160° from one another, e.g., from 60° to 120°, e.g., from 80° to 90°. For example, in FIG. 8, first and second elongate flanges 830 and 840 are shown to be disposed at angle slightly less than 90° (e.g., 87° or 85°).

In certain embodiments of the joint support as otherwise described herein, the first elongate flange tapers so as to decrease in thickness toward the outer edge of the first elongate flange, and the second elongate flange tapers so as to decrease in thickness toward the outer edge of the second elongate flange. For example, as shown in FIG. 10, first elongate flange 1030 of joint support 1000 is thicker near inner edge 1034, where it is closer to flexible hinge 1080, and tapers toward outer edge 1036, where it is thinner. In some embodiments, the thickness of first elongate flange tapers down to a thickness in a range from 0.25 mm to 1 mm, e.g., from 0.5 mm to 0.8 mm. In other embodiments, the thickness of the first elongate flange tapers down to a thickness of at least 0.25, e.g., at least 0.5. In yet other embodiments, the thickness of the first elongate flange tapers down to a thickness of at most 1 mm, e.g., at most 0.8. Similarly, second elongate flange 1040 is also thicker near inner edge 1044, where it is closer to flexible hinge 1080, and tapers toward outer edge 1046, where it is thinner. In some embodiments, the thickness of the second elongate flange tapers down to a thickness in a range from 0.25 mm to 1 mm, e.g., from 0.5 mm to 0.8 mm. In other embodiments, the thickness of the second elongate flange tapers down to a thickness of at least 0.25, e.g., at least 0.5. In yet other embodiments, the thickness of the second elongate flange tapers down to a thickness of at most 1 mm, e.g., at most 0.8.

In certain embodiments of the joint support as otherwise described herein, the support strip is formed of plastic. For example, the support strip may include at least one of High Density Polyethylene (HDPE), Polypropylene (PP), Polyethylene Terephthalate (PET), Acrylonitrile Butadiene Styrene (ABS) copolymer, Acrylonitrile Styrene Acrylate (ASA) copolymer, Polyvinyl Chloride (PVC), PETG, high-impact polystyrene (HIPS), Polycarbonate (PC), Polylactic Acid (PLA), or Polyester. In certain embodiments of the joint support as otherwise described herein, the support strip is reinforced with a fibrous material. For example, in some embodiments, the support strip is reinforced with glass fibers. In other embodiments, the support strip is reinforced with cellulose or other fibers. In other embodiments of the joint support as otherwise described herein, the support strip is formed of metal. For example, in some embodiments, the support strip of the support strip is formed of steel. In other embodiments, the support strip is formed of aluminum or an aluminum alloy.

In certain embodiments of the joint support as otherwise described herein, the joint support is a corner bead. For example, joint support 100 shown in FIGS. 1 and 2, joint support 300 shown in FIGS. 3 and 4, and joint support 800 shown in FIG. 8, are each configured to cover a joint between two panels that meet at a corner of a building surface. In some embodiments, the corner bead is formed as part of a rolled product for convenient storage and transport. For example, in some embodiments, the corner bead is configured to be rolled along its length during storage. Upon installation of such a corner bead, it is unrolled to its elongate form before or as it is applied over any building surface panels.

In certain embodiments of the joint support as otherwise described herein, each of the first elongate flange and the second elongate flange has a width in a range from ½ inch to 5 inches, e.g., from 1 inch to 3 inches, e.g., from 1.5 inches to 2 inches. In other embodiments, each of the first elongate flange and the second elongate flange has a width of at least 1 inch, e.g., at least 1.5 inches. In yet other embodiments, each of the first elongate flange and the second elongate flange has a width of at most 3 inches, e.g., at most 2 inches. Further, in certain embodiments of the joint support as otherwise described herein, the length is in a range from 4 feet to 20 feet, e.g., from 6 feet to 15 feet, e.g., from 8 feet to 12 feet. In other embodiments, the length is at least 4 feet, e.g., at least 6 feet, e.g., at least 8 feet. In yet other embodiments, the length is at most 20 feet, e.g., at most 15 feet, e.g., at most 12 feet.

In certain embodiments of the joint support as otherwise described herein, the outer facing sheet is a widest layer of the elongate layered structure. A widest layer is wider than all other layers in the elongate layered structure. For example, as shown in elongate layered structure 802 of FIG. 8, outer facing sheet 850 is shown to be wider than both support strip 820 and inner facing sheet 860. This additional width allows outer facing sheet 850 to extend laterally past outer edge 836 of first elongate flange 830 and extend laterally past outer edge 846 of second elongate flange 840. Notably, outer edge 836 and outer edge 846 form respective ends of support strip 820 and the width of support strip 820 is defined with respect to outer edge 836 and outer edge 846. In some embodiments, the outer facing sheet extends laterally at least 0.5 inches past the outer edge of the first elongate flange and extends laterally at least 0.5 inches past the outer edge of the second elongate flange. e.g., extends 1 inch past, e.g., extends 2 inches past.

In certain embodiments of the joint support as otherwise described herein, the support strip is a thickest layer of the elongate layered structure. A thickest layer is thicker than all other layers in the elongate layered structured. For example, as shown in elongate layered structure 1002 of FIG. 10, support strip 1020 is shown to be thicker than both outer facing sheet 1050 and inner facing sheet 1060. The thickness of the support strip increases the overall strength of the joint support. In some embodiments, the support strip is at least 50% thicker than the next thickest layer, e.g., at least 70% thicker, e.g., at least 100% thicker. In other embodiments, other layers of the elongate layered structure are thicker than the support strip.

In certain embodiments of the joint support as otherwise described herein, the outer facing sheet is a thickest facing sheet of the elongate layered structure. A thickest facing sheet is thicker than all other facing sheets in the elongate layered structured. For example, as shown in elongate layered structure 802 of FIG. 8, outer facing sheet 850 is thicker than inner facing sheet 860. In some embodiments, the outer facing sheet is at least 50% thicker than the next thickest facing sheet, e.g., at least 70% thicker, e.g., at least 100% thicker. In some embodiments, the outer facing sheet is the only facing sheet in the elongate layered structure and thus, by default, is the thickest facing sheet in the elongate layered structure. In other embodiments, other facing sheets of the elongate layered structure are thicker than the outer facing sheet.

In certain embodiments of the joint support as otherwise described herein, the outer facing sheet is disposed on at least the entire outside surface of the support strip. For example, in FIG. 8, outer facing sheet 850 covers the entirety of outside surface 822 of support strip 820. In other embodiments, the outer facing sheet is disposed on only a portion of the outside surface of the support strip, e.g., disposed on 75% of the outside surface, e.g., disposed on 50% of the outside surface.

In certain embodiments of the joint support as otherwise described herein, the inner facing sheet is disposed on at least the entire inside surface of the support strip. For example, in FIG. 8, inner facing sheet 860 covers the entirety of inside surface 824 of support strip 820. In other embodiments, the inner facing sheet is disposed on only a portion of the inside surface of the support strip, e.g., disposed on 75% of the inside surface, e.g., disposed on 50% of the inside surface.

In certain embodiments of the joint support as otherwise described herein, the inside surface of the elongate layered structure is textured. For example, in some embodiments, the inside surface includes a plurality of protruding structures in the form of ridges, posts, whiskers or undulations that extend outward from the surface. Further, in some embodiments, the protruding structures can serve as mixing elements to help mix or spread components of an adhesive substance disposed on the inside surface, for example when the structures are briefly pushed back and forth against an opposing surface.

Figure 11:
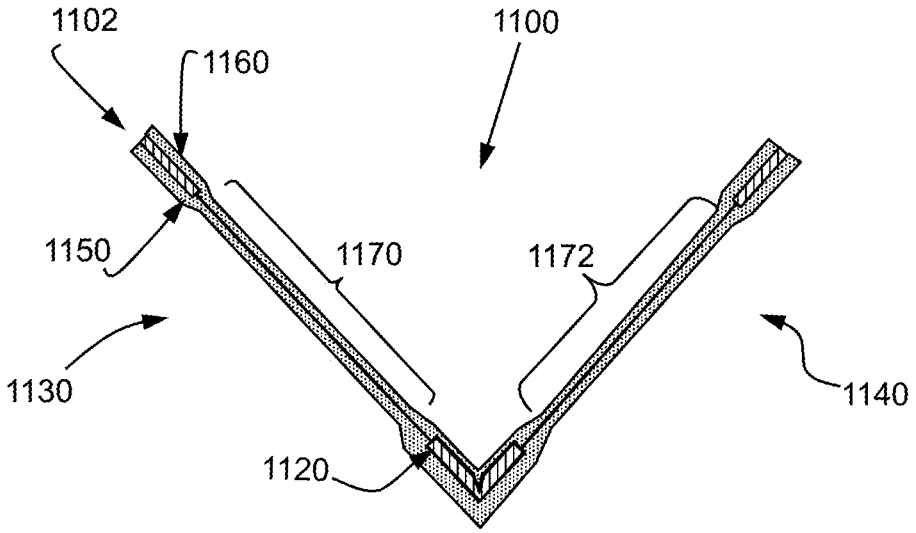
FIG. 11 is a schematic cross sectional view of a joint support according to another embodiment of the disclosure.

In certain embodiments of the joint support as otherwise described herein, the inner facing sheet and the outer facing sheet are joined together through the apertures. A cross sectional view of such a joint support is shown in FIG. 11. Joint support 1100 includes elongate layered structure 1102. Elongate layered structure 1102 includes support strip 1120, outer facing sheet 1150 and inner facing sheet 1160 as part of its layers. Outer facing sheet 1150 is attached to the outside surface of support strip 1120 and inner facing sheet 1160 is attached to the inside surface of support strip 1120. Further, support strip 1120 includes first elongate flange 1130 and second elongate flange 1140. Region 1170 of elongate layered structure 1102 corresponds to a region in which first elongate flange 1130 contains an aperture. Outer facing sheet 1150 and inner facing sheet 1160 are attached together through the aperture at region 1170. Likewise, region 1172 of elongate layered structure 1102 corresponds to a region in which second elongate flange 1140 contains an aperture. Outer facing sheet 1150 and inner facing sheet 1160 are also attached together through the aperture at region 1172.

Figure 12:
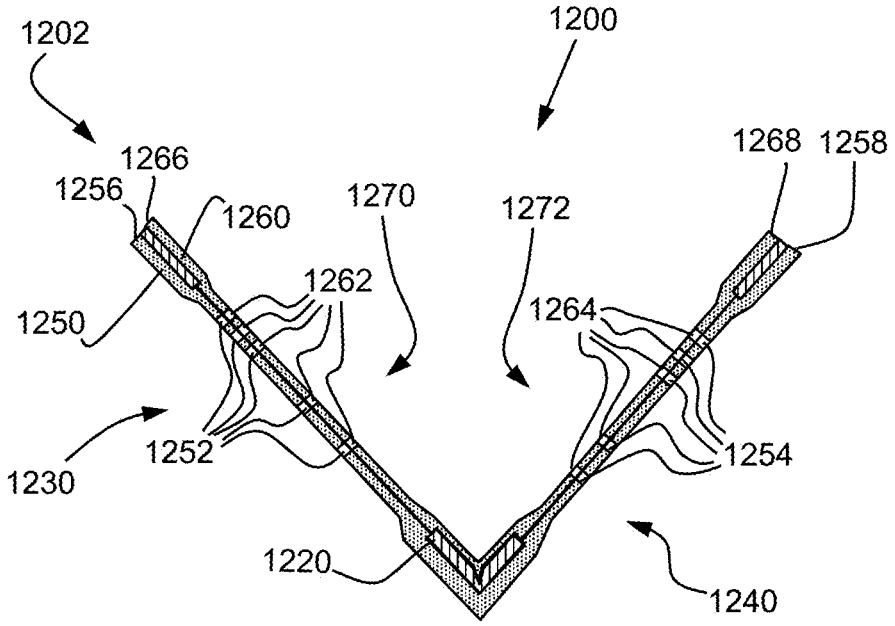
FIG. 12 is a schematic cross sectional view of a joint support according to yet another embodiment of the disclosure.

In certain embodiments of the joint support as otherwise described herein, each of the inner facing sheet and the outer facing sheet includes perforations in regions that coincide with the apertures. A cross sectional view of such a joint support is shown in FIG. 12. Joint support 1200 includes elongate layered structure 1202. Elongate layered structure 1202 includes support strip 1220, outer facing sheet 1250 and inner facing sheet 1260 as part of its layers. Outer facing sheet 1250 is attached to the outside surface of support strip 1220 and inner facing sheet 1260 is attached to the inside surface of support strip 1220. Further, support strip 1220 includes first elongate flange 1230 and second elongate flange 1240. Region 1270 of elongate layered structure 1202 is a region in which first elongate flange 1230 contains an aperture. Accordingly, regions of outer facing sheet 1250 that align with region 1270 contain perforations 1252 and regions of inner facing sheet 1260 that align with region 1270 contain perforations in 1262. Likewise, region 1272 of elongate layered structure 1202 is a region in which second elongate flange 1240 contains an aperture. Accordingly, regions of outer facing sheet 1250 that align with region 1272 contain perforations 1254 and regions of inner facing sheet 1260 that align with region 1272 contain perforations in 1264. In other embodiments, each of the inner facing sheet and the outer facing sheet includes perforations in regions that do not coincide with the apertures.

In certain embodiments of the joint support as otherwise described herein, the perforations are the same size as the apertures. In other embodiments of the joint support as otherwise described herein, the perforations are smaller than the apertures. For example, the perforations could be 50% of the size of the apertures, 25% of the size of the apertures, or 10% of the size of the apertures, among other possibilities.

In certain embodiments of the joint support as otherwise described herein, each of the perforations could have a width of at least 10 mm. e.g., at least 12 mm, e.g., at least 14 mm. In some embodiments, the perforations are each relatively the same size (e.g., within 1 mm of each other in size). In other embodiments, the perforations are each exactly the same size. In yet other embodiments, the perforations are each different sizes.

In certain embodiments of the joint support as otherwise described herein, the perforations of the inner facing sheet coincide with the perforations of the outer facing sheet. For example, as shown in FIG. 12, perforations 1252 of outer facing sheet 1250 coincide with perforations 1262 of inner facing sheet 1260. Likewise, perforations 1254 of outer facing sheet 1250 coincide perforations 1264 of inner facing sheet 1260. When the perforations of the outer facing sheet and the inner facing sheet are aligned, a joint compound or mechanical fastener can be pass through the entirety of the joint support and can attach directly to a building surface. In other embodiments, the perforations of the inner facing sheet do not coincide with the perforations of the outer facing sheet.

In certain embodiments of the joint support as otherwise described herein, the perforations of the inner facing sheet are more concentrated towards outer edges of the inner facing sheet and the perforations of the outer facing sheet are more concentrated towards outer edges of the outer facing sheet. For example, as shown in FIG. 12, perforations 1252 and 1254 of outer facing sheet 1250 are respectively more concentrated towards outer edges 1256 and 1258 of outer facing sheet 1250. Likewise, perforations 1262 and 1264 of inner facing sheet 1260 are respectively more concentrated towards outer edges 1266 and 1268 of inner facing sheet 1260. In other embodiments, the perforations of the inner facing sheet are more concentrated towards inner edges of the inner facing sheet and the perforations of the outer facing sheet are more concentrated towards inner edges of the outer facing sheet.

In another aspect, the disclosure provides a building surface construction including a first building surface panel and a second building surface panel adjacent to the first building surface panel so as to form a seam between the first building surface panel and second building surface panel. A joint support is disposed over the first building surface panel and the second building surface panel and covers at least a portion of the seam. The joint support may include any of the features of the joint supports as described above.

Figure 13:
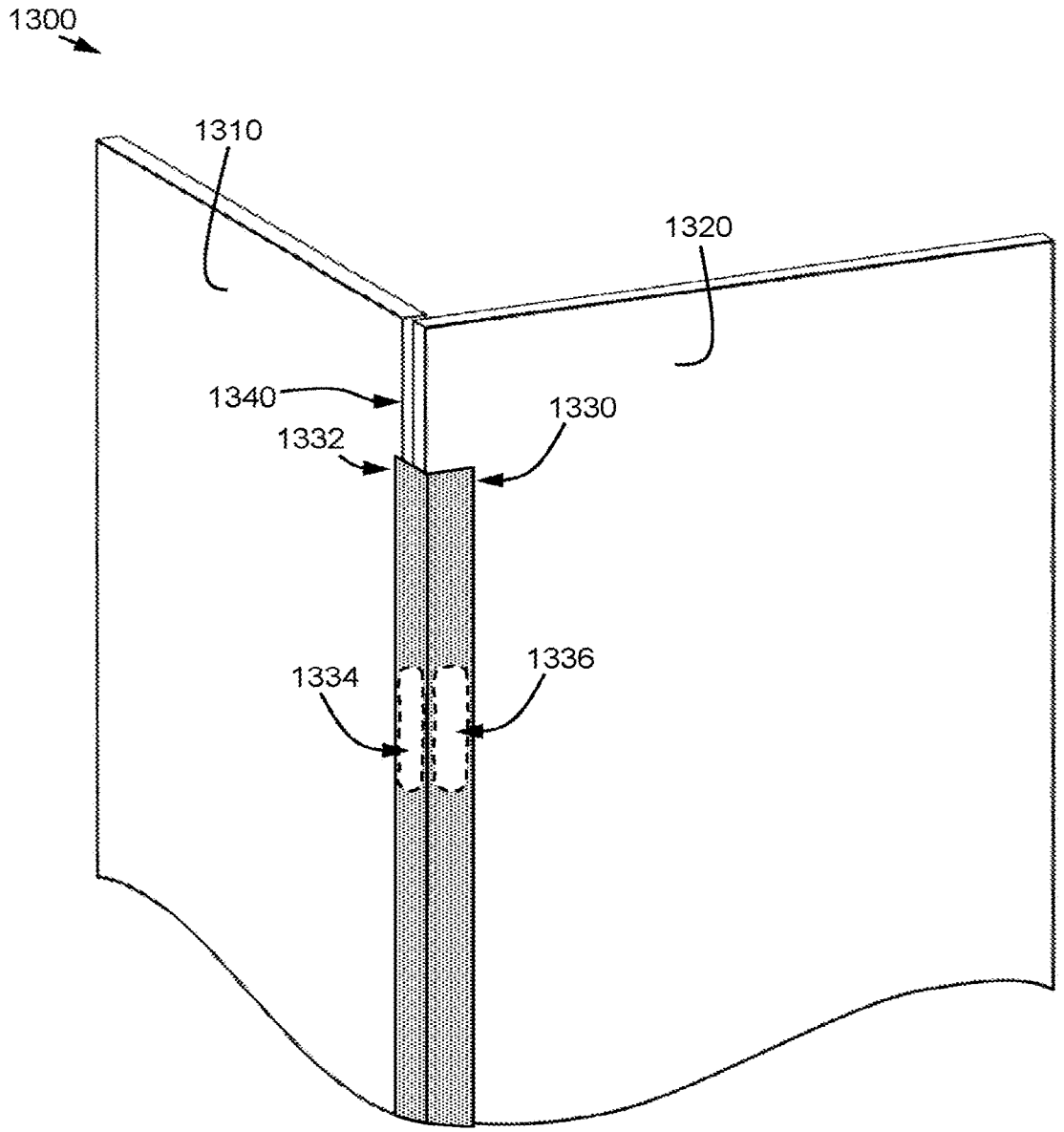
FIG. 13. is a schematic perspective view of a building surface construction according to an embodiment of the disclosure.

Such a building construction is shown in perspective view in FIG. 13. Building construction 1300 includes first building surface panel 1310 and second building surface panel 1320. Joint support 1330 is placed over an edge of a first building panel 1310 and an edge of a second building panel 1320 so as to cover a portion of a seam 1340 between the two building surface panels. In the depicted embodiment, joint support 1330 is positioned at a distance from the upper edges of first building panel 1310 and second building panel 1320. However, in other embodiments, the joint support extends to the edge of the panels and the portion of the seam that is covered is the entire seam. Further, joint support 1330 includes elongate layered structure 1332, which in turn includes apertures 1334 and 1336. The dashed lines that define apertures 1334 and 1336 denote that apertures 1334 and 1336 do not actually exist on the outside surface of elongate layered structure 1332, but rather exist as part of a support strip layer within elongate layered structure 1332. Nonetheless, FIG. 13 includes apertures 1334 and 1336 in order to illustrate how those apertures are positioned with respect to first building panel 1310 and second building panel 1320.

In certain embodiments of the building surface construction as otherwise described herein, the first and second building surface panels are drywall panels. In other embodiments, the building surface panels have other forms, such as cement boards or concrete panels. For example, in some embodiments, each of the building surface panels is a panel that includes a gypsum core surrounded by a facing material, such as a paper facing.

In certain embodiments of the building surface construction as otherwise described herein, the first building surface panel and the second building surface panel are disposed at an angle of about 90°, e.g., in a range from 87° to 93° degrees. In other embodiments of the building surface construction as otherwise described herein, the first building surface panel and the second building surface panel are disposed at an angle in a range from 30° (e.g., acute) to 180° (e.g., flat), e.g., from 45° to 150°, e.g., from 60° to 120°, e.g., from 80° to 100°. In other embodiments, the first building surface panel and the second building surface panel are disposed at an angle of at least 30°, e.g., at least 45°, e.g., at least 60°. In yet other embodiments, the first building surface panel and the second building surface panel are disposed at an angle of at most 180°, e.g., at most 150°, e.g., at most 100°.

Figure 14:
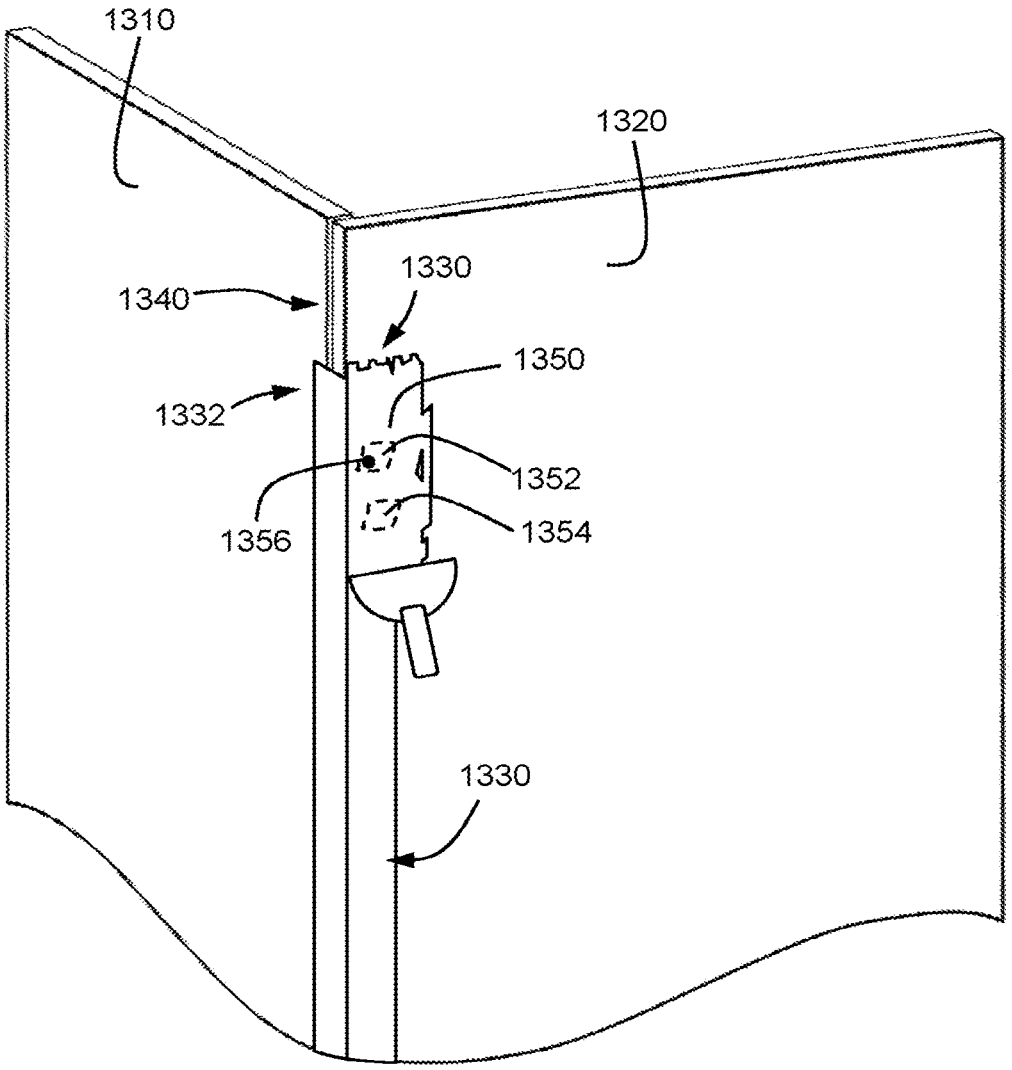
FIG. 14. is a schematic perspective view of a building surface construction according to another embodiment of the disclosure.

In certain embodiments of the building surface construction as otherwise described herein, the building surface construction further includes a joint compound coating the outside surface of the elongate layered structure. For example, as depicted in FIG. 14, a coating of joint compound 1350 is provided over the outside surface of elongate layered structure 1332 and second building surface panel 1320. In some embodiments, the joint compound is spread out over the joint support and extends laterally beyond the edges of the joint support over the surfaces of the first and second building surface panels. The inclusion of such a joint compound coating provides for a smooth transition between the joint support and the building surface panels.

In certain embodiments of the building surface construction as otherwise described herein, the joint compound seeps through the apertures of the support strip and the perforations of the inner facing sheet and the outer facing sheet so as to directly contact the first and second building surface panels. For example, in FIG. 14, regions 1352 and 1354 correspond to regions of elongate layered structure 1332 in which the support strip layer has an aperture, the inner facing sheet has a perforation, and the outer facing sheet has a perforation. Due to these three openings, the apertures in the layered structure and the perforations in each of the inner and outer facing sheets, joint compound 1350 is able to directly contact the surface of second building surface panel 1320.

Figure 15:
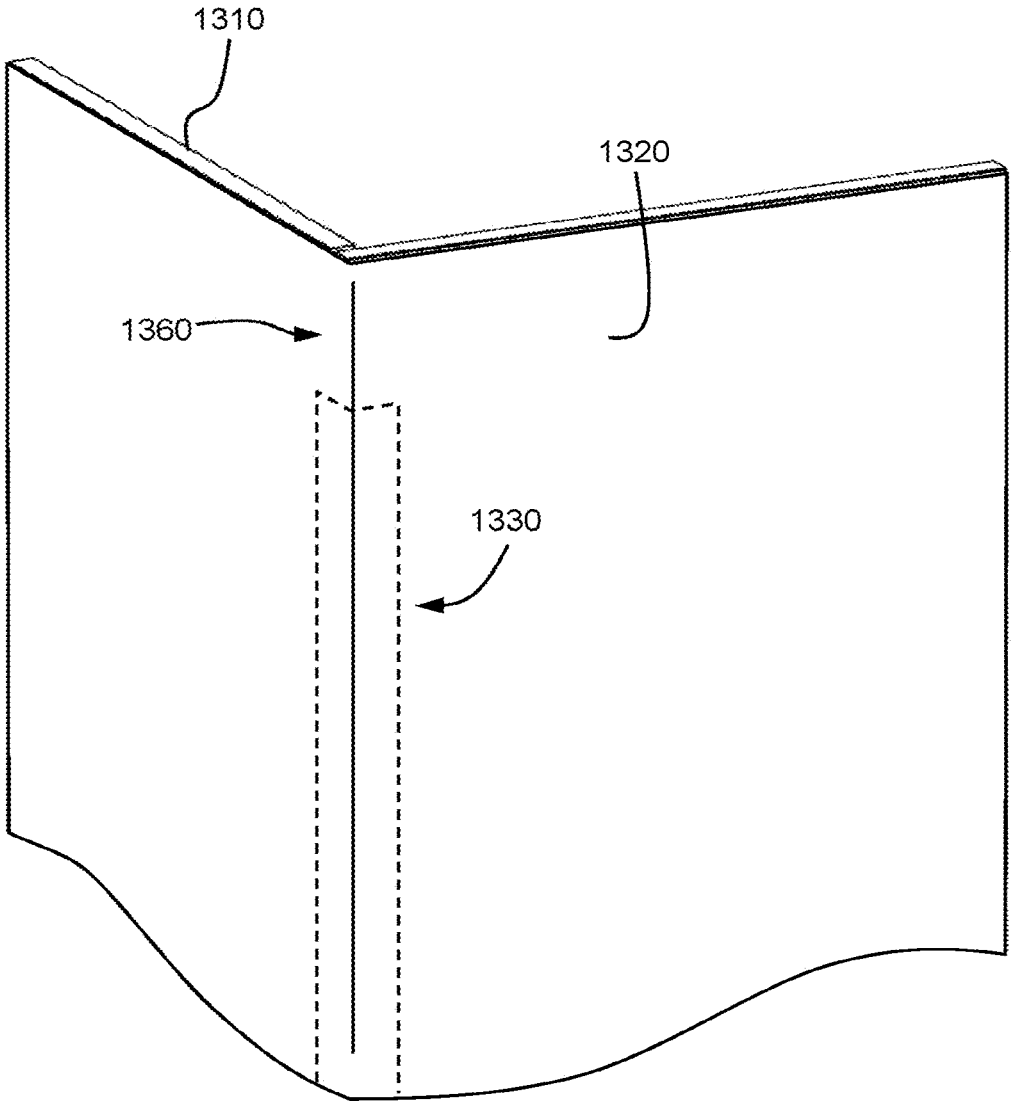
FIG. 15. is a schematic perspective view of a building surface construction according to yet another embodiment of the disclosure.

In certain embodiments of the building surface construction as otherwise described herein, the building surface construction further includes a layer of paint covering the joint compound. For example, as shown in FIG. 15, joint support 1330 is covered by a layer of paint 1360. The painted joint support forms a clean and sharp corner over the seam of the building surface panels. The paint obscures the joint support and, in some embodiments, provides a continuous texture over the building surface construction across both the building surface panels and the joint support.

In certain embodiments of the building surface construction as otherwise described herein, the building construction further includes mechanical fasteners extending through the apertures of the support strip and the perforations of the inner facing sheet and the outer facing sheet such that the mechanical fasteners assist in attaching the joint support to the first and second building surface panels. For example, in FIG. 14, mechanical fastener 1356 extends through region 1352 so as to fasten to second building surface panel 1320. The mechanical fasteners help to attach the joint support to the building surface panels.

In certain embodiments of the building surface construction as otherwise described herein, the inside surface of the elongate layered structure is attached to the first building surface panel and the second building surface panel. For example, as shown in FIG. 13, the inside surface of elongate layered structure 1332 is disposed over the outside surface of first building surface panel 1310 at the edge near second building surface panel 1320. Likewise, the inside surface of elongate layered structure 1332 is disposed over the outside surface of second building surface panel 1320 at the edge near first building surface panel 1310.

Another aspect of the present disclosure provides a method for manufacturing the joint support according to any of the embodiments described above. The method includes extruding the support strip. The method additionally includes providing the outer facing sheet. The method further includes securing the outer facing sheet to the outside surface of the support strip so as to form the elongate layered structure.

Figure 16:
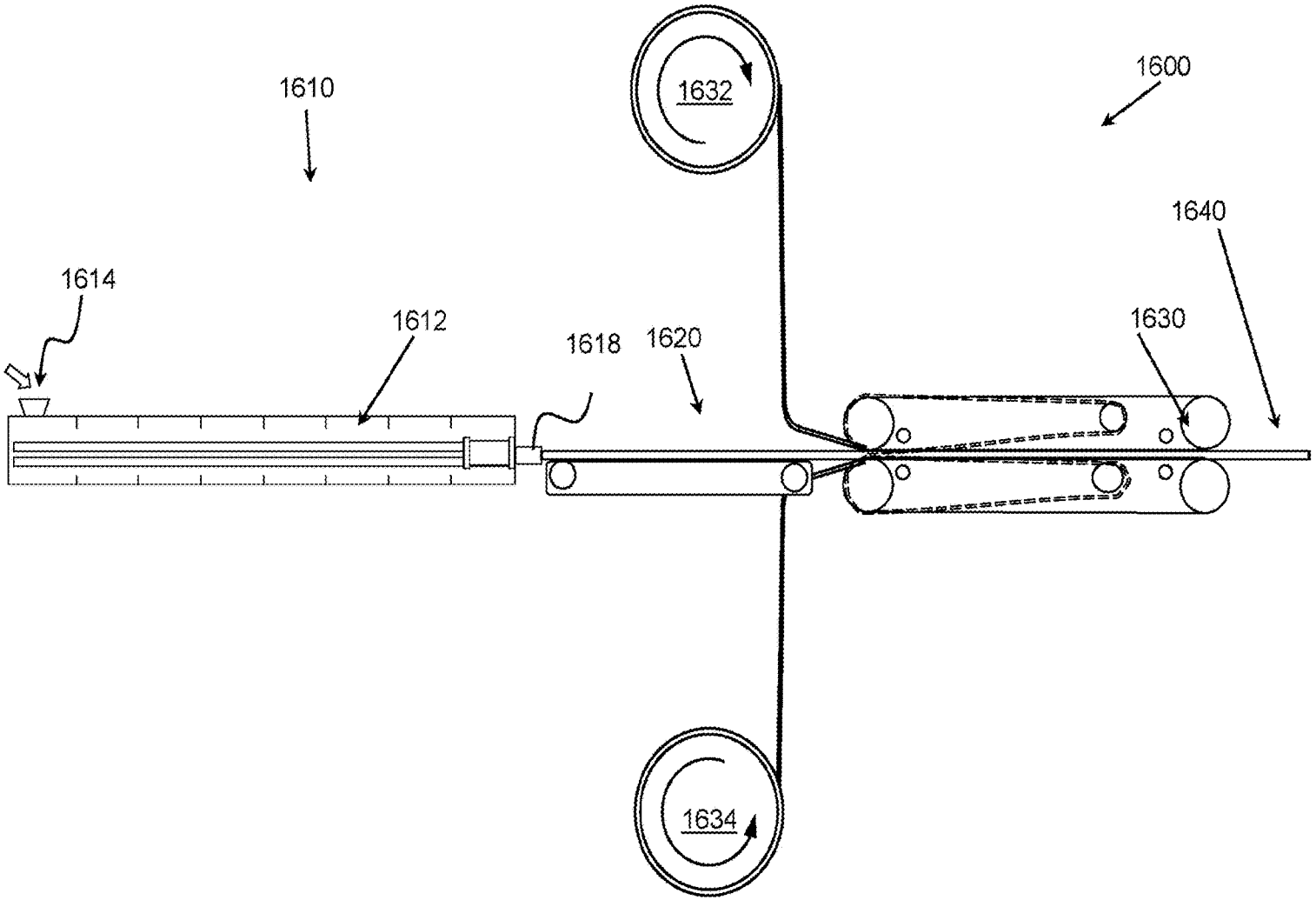
FIG. 16 is a schematic side view of a system for manufacturing a joint support, according to an embodiment of the disclosure.

A system for carrying out such a method is shown in FIG. 16. System 1600 includes an extruder 1610, conveyor 1620, and a laminator 1630.

Extruder 1610 includes extruder body 1612 that contains component materials as they pass through the extruder. Extruder body 1612 includes inlet 1614 configured to allow the introduction of various component materials into extruder body 1612 and outlet 1618. Extruder 1610 is operable to receive component materials and responsively extrude a support strip from those component materials. Extruder 1610 outputs the support strip at outlet 1618, after which the support strip is handed to conveyor 1620 and then moved to laminator 1630.

Laminator 1630 is configured to laminate multiple materials into a single elongate layered structure. Laminator 1630 is coupled to roll of material 1632, which provides the outer facing sheet to laminator 1630. After receiving the extruded support strip from conveyor 1620, laminator 1630 takes the support strip and secures the outer facing sheet to the outside surface of the support strip so as to form elongate layered structure 1640.

In some embodiments, the method further includes providing an inner facing sheet and securing the inner facing sheet to the support strip. For example, laminator 1630 is also coupled to roll of material 1634 which provides the inner facing sheet to laminator 1630. In such embodiments, the laminator can secure the inner facing sheet to the inside surface of the support strip while simultaneously securing the outer facing sheet to the outside surface of the support strip.

In certain embodiments as otherwise described herein, the extruder includes one or more rotatable screws configured to mix the component materials introduced into the extruder body and to convey the mixture to the outlet of the extruder body. The person of ordinary skill in the art will appreciate that a wide variety of screw designs are suitable for use in the extruder including single or twin screws and having sections with various configurations including, but not limited to, transfer screws, slotted screws, lobal screws, kneading blocks, conveying elements, reverse screws and combinations thereof.

In certain embodiments as otherwise described herein, the component materials fed to the extruder could include Polyurethane, Polypropylene, High Density Polyethylene (HDPE), Polyethylene Terephthalate (PET), Acrylonitrile Butadiene Styrene (ABS) copolymer, Acrylonitrile Styrene Acrylate (ASA) copolymer, Polyvinyl Chloride (PVC), PETG, high-impact polystyrene (HIPS), Polycarbonate (PC), Polylactic Acid (PLA), or Polyester.

In certain embodiments of the method otherwise described herein, securing the outer facing sheet to the outside surface of the support strip includes heating the support strip to a predetermined temperature and bonding an inside surface of the outer facing sheet to the outside surface of the support strip. For example, when passing from conveyor 1620 to laminator 1630, the support strip is heated to a predefined temperature so as to form a tacky outside surface on the support strip. Subsequently, laminator 1630 bonds the inside surface of the outer facing sheet that is drawn from roll of material 1632 to the outside surface of the support strip.

In certain embodiments of the method as otherwise described herein, securing the outer facing sheet to the outside surface of the support strip includes providing an adhesive on the outer facing sheet and applying pressure to the outer facing sheet and the support strip so as to form a bond between the inside surface of the outer facing sheet and the outside surface of the support strip. For example, in some embodiments, after exiting the extruder, an adhesive substance is applied to the inside surface of the outer facing sheet. In some embodiments, the laminator subsequently applies pressure to the outer facing sheet and support strip to form an adhesive bond between the inside surface of the outer facing sheet and the outside surface of the support strip.

In certain embodiments of the method as otherwise described herein, the method further includes forming the apertures in the support strip. In some embodiment, forming the apertures involves, during the extruding, dynamically changing a shape of an extrusion die of the extruder so as to form the apertures. For example, in some embodiments, during the extrusion process, an insert is moved into and out of the extrusion die so as to dynamically change the shape of the extrusion die. Such movement thereby forms the apertures in the support strip. In other embodiments, forming the apertures involves cutting the apertures in the support strip. For example, in some embodiments, a human operator cuts the apertures in the support strip. In other embodiments, a machine cuts the apertures in the support strip.

In certain embodiments of the method as otherwise described herein, forming the apertures in the support strip occurs before securing the outer facing sheet to the outside surface of the support strip. For example, in some embodiments, a human operator forms the apertures after the support strip is extruded out of extruder 1610 but before the support strip is delivered by conveyor 1620 to laminator 1630.

In certain embodiments of the method as otherwise described herein, the method further comprises forming perforations in the outer facing sheet. In some embodiments, forming the perforations involves cutting the perforations in the outer facing sheet. For example, in some embodiments, a machine punches the perforations in the outer facing sheet. In some embodiments, forming the perforations occurs before securing the outer facing sheet to the outside surface of the support strip. In other embodiments, forming the perforations occurs after securing the outer facing sheet to the outside surface of the support strip.

Various aspects and embodiments of the disclosure are provided by the enumerated embodiments below, which can be combined in any number and in any fashion that is not technically or logically inconsistent.

Embodiment 1. A joint support comprising:

an elongate layered structure including a length that extends from a first end to a second end, an inside surface, and an outside surface, the elongate layered structure comprising:

a support strip that extends from the first end to the second end, the support strip including an inside surface, an outside surface, and first and second elongate flanges, each of the first and second elongate flanges having a width that extends from an inner edge to an outer edge;

an inner facing sheet disposed on the inside surface of the support strip; and an outer facing sheet disposed on the outside surface of the support strip, wherein the each of the inner facing sheet and the outer facing sheet is formed from a fibrous polymer material.

Embodiment 2. The joint support according to embodiment 1, wherein at least one of the inner facing sheet and the outer facing sheet comprises a nylon ribbon.

Embodiment 3. The joint support according to any of embodiments 1 to 2, wherein at least one of the inner facing sheet and the outer facing sheet is made of individual nylon fibers.

Embodiment 4. A joint support comprising:

an elongate layered structure including a length that extends from a first end to a second end, an inside surface, and an outside surface, the elongate layered structure comprising:

a support strip that extends from the first end to the second end, the support strip including an inside surface, an outside surface, and first and second elongate flanges, each of the first and second elongate flanges having a width that extends from an inner edge to an outer edge, wherein each flange of the first and second elongate flanges includes apertures therethrough, each aperture having a width that extends laterally across at least 50% of the width of the respective flange; and an outer facing sheet disposed on the outside surface of the support strip.

Embodiment 5. The joint support according to embodiment 4, wherein the width of each aperture is at least 20 mm. e.g., at least 25 mm, e.g., at least 40 mm.

Embodiment 6. The joint support according to any of embodiments 4 to 5, wherein the apertures are spaced uniformly along the length of the support strip.

Embodiment 7. The joint support according to any of embodiments 4 to 5, wherein the apertures are spaced non-uniformly along the length of the support strip.

Embodiment 8. The joint support according to any of embodiments 4 to 7, wherein the apertures include non-polygonal shaped apertures.

Embodiment 9. The joint support according to any of embodiments 4 to 8, wherein the apertures include ellipse shaped apertures.

Embodiment 10. The joint support according to any of embodiments 4 to 9, wherein the apertures include polygonal shaped apertures.

Embodiment 11. The joint support according to any of embodiments 4 to 10, wherein the apertures include rectangular shaped apertures.

Embodiment 12. The joint support according to any of embodiments 4 to 11, wherein the apertures include diamond shaped apertures.

Embodiment 13. The joint support according to any of embodiments 4 to 12, further comprising an inner facing sheet disposed on the inside surface of the support strip.

Embodiment 14. The joint support according to embodiment 13, wherein the at least one of the inner facing sheet and the outer facing sheet is formed from a fibrous polymer material.

Embodiment 15. The joint support according to any of embodiments 13 to 14, wherein at least one of the inner facing sheet and the outer facing sheet comprises a nylon ribbon.

Embodiment 16. The joint support according to any of embodiments 13 to 15, wherein at least one of the inner facing sheet and the outer facing sheet is made of individual nylon fibers.

Embodiment 17. The joint support according to any of embodiments 1 to 16, further comprising an adhesive substance disposed on the inside surface of the elongate layered structure.

Embodiment 18. The joint support according to embodiment 17, wherein the adhesive substance includes at least one of alkyl acrylate, acrylic acid-alkyl acrylate, methacrylate, epoxy resins, polyvinyl acetate, methylene diphenyl diisocyanate (MID), urethane, and styrene butadiene.

Embodiment 19. The joint support according to any of embodiments 1 to 18, wherein the support strip includes a sharp corner connecting the first elongate flange and the second elongate flange.

Embodiment 20. The joint support according to embodiment 19, wherein the support strip includes a groove disposed on an inside surface of the sharp corner connecting the first elongate flange and the second elongate flange.

Embodiment 21. The joint support according to any of embodiments 1 to 18, wherein the support strip includes a rounded corner connecting the first elongate flange and the second elongate flange so as to form a bull-nose corner bead.

Embodiment 22. The joint support according to any of embodiments 1 to 18, wherein the first elongate flange is connected to the second elongate flange by a flexible hinge.

Embodiment 23. The joint support according to any of embodiments 1 to 22, wherein the first elongate flange and second elongate flange are disposed at an angle in a range from 45° to 160° from one another, e.g., from 60° to 120°, e.g., from 80° to 90°.

Embodiment 24. The joint support according to any of embodiments 1 to 23, wherein the first elongate flange tapers so as to decrease in thickness toward the outer edge of the first elongate flange, and the second elongate flange tapers so as to decrease in thickness toward the outer edge of the second elongate flange.

Embodiment 25. The joint support according to any of embodiments 1 to 24, wherein the support strip is formed of plastic.

Embodiment 26. The joint support according to any of embodiments 1 to 25, wherein the support strip includes at least one of High Density Polyethylene (HDPE), Polyethylene Terephthalate (PET), or Acrylonitrile Butadiene Styrene (ABS).

Embodiment 27. The joint support according to any of embodiments 1 to 26, wherein the joint support is a corner bead.

Embodiment 28. The joint support according to any of embodiments 1 to 27, wherein each of the first elongate flange and the second elongate flange has a width in a range from ½ inch to 5 inches, e.g., from 1 inch to 3 inches, e.g., from 1.5 inches to 2 inches.

Embodiment 29. The joint support according to any of embodiments 1 to 28, wherein the length is in a range from 4 feet to 20 feet, e.g., from 6 feet to 15 feet, e.g., from 8 feet to 12 feet.

Embodiment 30. The joint support according to any of embodiments 1 to 29, wherein the outer facing sheet is a widest layer of the elongate layered structure.

Embodiment 31. The joint support according to any of embodiments 1 to 30, wherein the outer facing sheet extends laterally past the outer edge of the first elongate flange and extends laterally past the outer edge of the second elongate flange.

Embodiment 32. The joint support according to any of embodiments 1 to 31, wherein the outer facing sheet extends laterally at least 0.5 inches past the outer edge of the first elongate flange and extends laterally at least 0.5 inches past the outer edge of the second elongate flange. e.g., extends 1 inch past, e.g., extends 2 inches past.

Embodiment 33. The joint support according to any of embodiments 1 to 32, wherein the support strip is a thickest layer of the elongate layered structure.

Embodiment 34. The joint support according to any of embodiments 1 to 33, wherein the outer facing sheet is a thickest facing sheet of the elongate layered structure.

Embodiment 35. The joint support according to any of embodiments 1 to 34, wherein the outer facing sheet is disposed on at least the entire outside surface of the support strip.

Embodiment 36. The joint support according to any of embodiments 1 to 35, wherein the inside surface of the elongate layered structure is textured.

Embodiment 37. The joint support according to any of embodiments 13 to 36, wherein the inner facing sheet is disposed on at least the entire inside surface of the support strip.

Embodiment 38. The joint support according to any of embodiments 13 to 37, wherein the inner facing sheet and the outer facing sheet are joined together through the apertures.

Embodiment 39. The joint support according to any of embodiments 13 to 38, wherein each of the inner facing sheet and the outer facing sheet includes perforations in regions that coincide with the apertures.

Embodiment 40. The joint support according to embodiment 39, wherein the perforations are the same size as the apertures.

Embodiment 41. The joint support according to embodiment 39, wherein the perforations are smaller than the apertures.

Embodiment 42. The joint support according to any of embodiments 39 to 41, wherein each of the perforations has a width of at least 10 mm. e.g., at least 12 mm, e.g., at least 14 mm.

Embodiment 43. The joint support according to any of embodiments 39 to 42, wherein the perforations of the inner facing sheet coincide with the perforations of the outer facing sheet.

Embodiment 44. The joint support according to any of embodiments 39 to 43, wherein the perforations of the inner facing sheet are more concentrated towards outer edges of the inner facing sheet, and wherein the perforations of the outer facing sheet are more concentrated towards outer edges of the outer facing sheet.

Embodiment 45. A building surface construction using the joint support of any of embodiments 1 to 44, the building surface construction comprising:

a first building surface panel;

a second building surface panel adjacent to the first building surface panel so as to form a seam between the first building surface panel and the second building surface panel; and the joint support disposed over the first building surface panel and the second building surface panel and covering a portion of the seam.

Embodiment 46. The building surface construction of embodiment 45, wherein the first and second building surface panels are drywall panels.

Embodiment 47. The building surface construction of any of embodiments 45 to 46, wherein the first building surface panel and the second building surface panel are disposed at an angle of about 90°.

Embodiment 48. The building surface construction of any of embodiments 45 to 47, further comprising a joint compound coating the outside surface of the elongate layered structure.

Embodiment 49. The building surface construction of embodiment 48, wherein the joint compound seeps through the apertures of the support strip and the perforations of the inner facing sheet and the outer facing sheet so as to directly contact the first and second building surface panels.

Embodiment 50. The building surface construction of any of embodiments 48 to 49, further comprising a layer of paint covering the joint compound.

Embodiment 51. The building surface construction of any of embodiments 45 to 50, further comprising mechanical fasteners extending through the apertures of the support strip and the perforations of the inner facing sheet and the outer facing sheet such that the mechanical fasters assist in attaching the joint support to the first and second building surface panels.

Embodiment 52. The building surface construction of any of embodiments 45 to 51, wherein the inside surface of the elongate layered structure is attached to the first building surface panel and the second building surface panel.

Embodiment 53. A method for manufacturing the joint support according to any of embodiments 1 to 44, the method comprising:

extruding the support strip;

providing the outer facing sheet, and securing the outer facing sheet to the outside surface of the support strip so as to form the elongate layered structure.

54. The method according to embodiment 53, wherein the securing includes:

heating the support strip to a predetermined temperature; and bonding an inside surface of the outer facing sheet to the outside surface of the support strip.

55. The method according to embodiment 53, wherein the securing includes:

providing an adhesive on an inside surface of the outer facing sheet;

applying pressure to the outer facing sheet, and the support strip so as to form a bond between the inside surface of the outer facing sheet and the outside surface of the support strip.

56. The method according to any of embodiments 53 to 55, further comprising forming the apertures in the support strip.

57. The method according to embodiment 56, wherein extruding the support strip comprises forming the support strip by way of an extrusion die, and wherein forming the apertures in the support strip comprises dynamically changing a shape of the extrusion die during the extruding so as to form the apertures.

58. The method according to embodiment 56, wherein forming the apertures comprises cutting the apertures in the support strip.

59. The method according to any of embodiments 56 to 58, wherein forming the apertures in the support strip occurs before securing the outer facing sheet to the outside surface of the support strip.

60. The method according to any of embodiments 53 to 59, further comprising forming perforations in the outer facing sheet.

61. The method according to embodiment 60, wherein forming the perforations comprises cutting the perforations in the outer facing sheet.

62. The method according to any of embodiments 60 to 61, wherein forming the perforations occurs before securing the outer facing sheet to the outside surface of the support strip.

63. The method according to any of embodiments 60 to 61, wherein forming the perforations occurs after securing the outer facing sheet to the outside surface of the support strip.

64. The method according to any of embodiments 53 to 63, further comprising:

providing an inner facing sheet; and securing the inner facing sheet to the inside surface of the support strip.

65. The method according to embodiment 64, wherein securing the inner facing sheet to the inside surface of the support strip and securing the outer facing sheet to the outside surface of the support strip occur simultaneously.

It will be apparent to those skilled in the art that various modifications and variations can be made to the processes and devices described here without departing from the scope of the disclosure. Thus, it is intended that the present disclosure cover such modifications and variations of this invention provided they come within the scope of the appended claims and their equivalents.

What is claimed is:

1. A joint support comprising:

an elongate layered structure including a length that extends from a first end to a second end, an inside surface, and an outside surface, the elongate layered structure comprising:

a support strip that extends from the first end to the second end, the support strip including an inside surface, an outside surface, and first and second elongate flanges, each of the first and second elongate flanges having a width that extends from an inner edge to an outer edge, wherein each flange of the first and second elongate flanges includes a group of apertures therethrough, each aperture of the group of apertures having a width that extends laterally across at least 50% of the width of a respective one of the first and second elongate flanges; and an outer facing sheet disposed on the outside surface of the support strip and covering the apertures of the support strip, the outer facing sheet being configured to receive a layer of joint compound thereon, wherein the outer facing sheet and the support strip are configured such that a joint compound received by the outer facing sheet does not pass through the outer facing sheet into the apertures of the support strip.

2. The joint support according to claim 1, wherein the width of each aperture of the group of apertures is at least 20 mm.

3. The joint support according to claim 1, further comprising an inner facing sheet disposed on the inside surface of the support strip.

4. The joint support according to claim 3, wherein the inner facing sheet is disposed on at least an entire inside surface of the support strip.

5. The joint support according to claim 1, wherein the support strip includes a sharp corner connecting the first elongate flange and the second elongate flange.

6. The joint support according to claim 1, wherein the first elongate flange tapers so as to decrease in thickness toward the outer edge of the first elongate flange, and the second elongate flange tapers so as to decrease in thickness toward the outer edge of the second elongate flange.

7. The joint support according to claim 1, wherein the joint support is a corner bead.

8. The joint support according to claim 1, wherein each of the first elongate flange and the second elongate flange has a width in a range from ½ inch to 5 inches, wherein the length is in a range from 4 feet to 20 feet.

9. The joint support according to claim 1, wherein the outer facing sheet extends laterally at least 0.5 inches past the outer edge of the first elongate flange and extends laterally at least 0.5 inches past the outer edge of the second elongate flange.

10. The joint support according to claim 1, wherein the inside surface of the elongate layered structure is textured.

11. A building surface construction using the joint support of claim 1, the building surface construction comprising:

a first building surface panel;

a second building surface panel adjacent to the first building surface panel so as to form a seam between the first building surface panel and the second building surface panel; and the joint support disposed over the first building surface panel and the second building surface panel and covering a portion of the seam.

12. The joint support according to claim 1, wherein each aperture of the group of apertures is spaced a uniform distance from the other apertures of the group of apertures along a length of the first and second elongate flanges.

13. The joint support according to claim 1, wherein each aperture of the group of apertures is non-polygonal in shape.

14. The joint support according to claim 1, wherein each aperture of the group of apertures has a width that extends laterally across at least 65% of the width of a respective one of the first and second elongate flanges.

15. The joint support according to claim 1, wherein each aperture of the group of apertures having a width that extends laterally across at least 75% of the width of a respective one of the first and second elongate flanges.

16. The joint support according to claim 1, wherein the width of each aperture of the group of apertures is at least 25 mm.

17. The joint support according to claim 1, wherein the width of each aperture of the group of apertures is at least 40 mm.

18. The joint support according to claim 1, wherein the outer facing sheet is formed from a fibrous polymer material.

19. The joint support according to claim 1, wherein the outer facing sheet comprises a nylon ribbon.

20. The joint support according to claim 1, wherein the outer facing sheet does not include perforations.

21. The joint support according to claim 1, wherein the outer facing sheet does not include perforations coinciding with the apertures of the support strip.

22. The joint support according to claim 21, wherein the outer facing sheet includes perforations not coinciding with the apertures of the support strip.

23. The joint support according to claim 1, further comprising an adhesive disposed at the inside surface thereof.

* * * * *